US007445037B2

(12) United States Patent
Heggset et al.

(10) Patent No.: US 7,445,037 B2
(45) Date of Patent: Nov. 4, 2008

(54) METHOD AND EQUIPMENT FOR CONTINUOUS OR SEMICONTINUOUS CASTING OF METAL

(75) Inventors: Bjarne Anders Heggset, Kristiansund N (NO); Bjørn Vaagland, Sunndalsøra (NO); Steinar Benum, Sunndalsøra (NO); Geir Olav Ånesbug, Frei (NO); Torstein Sæther, Sunndalsøra (NO); John Erik Hafsås, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 10/562,151

(22) PCT Filed: Jun. 25, 2004

(86) PCT No.: PCT/NO2004/000194

§ 371 (c)(1),
(2), (4) Date: Apr. 5, 2006

(87) PCT Pub. No.: WO2005/000500

PCT Pub. Date: Jan. 6, 2005

(65) Prior Publication Data

US 2006/0219378 A1 Oct. 5, 2006

(30) Foreign Application Priority Data

Jun. 30, 2003 (NO) ..... 20033001

(51) Int. Cl.
*B22D 11/049* (2006.01)
*B22D 11/10* (2006.01)

(52) U.S. Cl. ..... 164/487; 164/437; 164/444; 164/488

(58) Field of Classification Search ..... 164/487, 164/444, 488–490, 437–440
See application file for complete search history.

(56) References Cited

U.S. PATENT DOCUMENTS

| | | | | |
|---|---|---|---|---|
| 3,552,478 | A | 1/1971 | Lauener | |
| 3,718,175 | A | 2/1973 | Rinesch | |
| 4,071,072 | A * | 1/1978 | McCubbin | 164/487 |
| 4,157,728 | A | 6/1979 | Mitamura et al. | |
| 4,450,887 | A * | 5/1984 | Wilkins | 164/449.1 |
| 4,664,175 | A * | 5/1987 | Yanagimoto et al. | 164/455 |
| 5,915,455 | A | 6/1999 | Kittilsen et al. | |

FOREIGN PATENT DOCUMENTS

| | | |
|---|---|---|
| EP | 0717119 | 6/1996 |

* cited by examiner

*Primary Examiner*—Kuang Lin
(74) *Attorney, Agent, or Firm*—Wenderoth, Lind & Ponack, L.L.P.

(57) ABSTRACT

A method and equipment for continuous or semi-continuous casting of metal, in particular directly-cooled (DC) casting of aluminum, including at least one mold (3) with a mold cavity (11) that is provided with an inlet (4) linked to a metal store and an outlet with devices (27) for cooling the metal so that an object in the form of an extended string, rod or bar is cast through the outlet. The metal is supplied to the mold (3) in such a way and with such regulation that the metallostatic pressure in the contact point (solidification zone) against the mold wall is virtually zero during casting.

10 Claims, 5 Drawing Sheets

METHOD AND EQUIPMENT FOR CONTINUOUS OR SEMICONTINUOUS CASTING OF METAL

BACKGROUND OF THE INVENTION

1. Technical Field

The present invention concerns a method and equipment for continuous or semi-continuous casting of metal, in particular directly-cooled (DC) casting of aluminium, comprising a mold with a mold cavity or chill that is provided with an inlet linked to a metal store and an outlet with devices for cooling the metal so that an object in the form of an extended string, rod or bar is cast through the outlet.

2. Description of the Related Art

Equipment of the above type is widely known and used for casting alloyed or unalloyed metal that is processed further down the production chain, for example for remelting or extrusion purposes.

A major challenge for this type of prior art casting equipment has been to achieve a segregation-free, smooth surface on the product cast. This has been particularly important for products in which the surface is not removed before processing.

Surface segregation is assumed to be caused by two principal phenomena:

1. Inverse segregation: when the metal comes into contact with the chill, solidification will begin in a thin layer. This solidification will normally take place from the chill towards the center of the bar. When the metal makes the transition from the liquid to the solid phase, the volume will decrease at the outside and this must be replaced with alloyed melt from areas further inside the bar. This produces so-called inverse solidification because the segregation takes place towards the solidification front. This type of segregation typically produces a thin alloyed zone under the surface of the bar that is 10-20% higher in alloy elements than the nominal alloy content.
2. Blooms: when the solidified shell on the outside of the bar is not in physical contact with the chill wall, alloyed metal may be pressed out through the solidified or partially solidified shell (remelting). This solidification produces a thin, highly alloyed zone outside the original surface and a corresponding depleted zone under the original surface.

Inverse segregation is assumed, in turn, to be affected by:

1. Heat transfer from the bar to the chill walls.
2. The length of the contact zone between the chill and bar.
3. Grain refinement and solidification morphology.
4. Flows near the surface of the bar and their effect on the thermal field.
5. The alloy's specific properties (for example, thermal conductivity and solidification path).

Moreover, blooms are assumed to be affected by:

1. Heat transfer from the bar to the chill walls.
2. The distance between the contact zone in the chill and the water strike point.
3. Solidification morphology and grain refinement.
4. Stationary and periodic deformations of the outer shell (sponge effect).
5. Pressure differences over the solidified/semi-solidified shell.
6. Flows near the surface of the bar and their effect on the thermal field.

7. The alloy's specific properties (for example, thermal conductivity and solidification path).

To reduce segregation, the following are assumed to be important:

1. Reduced heat transfer between the chill and the bar. This also includes reduced friction between the chill wall and the bar.
2. Optimal distance between the start of the contact zone and the water strike point (must be adjusted in relation to the casting parameters and heat transfer between the chill and the bar).
3. Reduced metallostatic pressure above or in the chill.
4. Reduced fluctuations in the metal level (produces less segregation and fewer variations in surface topography).
5. Avoidance of periodic fluctuations in the contact zone on account of varying gas pressure and volume in the gas pocket inside the mold. This produces the characteristic rings seen on the surface of metal bars or rods.

The only method in daily use that can result in a bar without surface segregation is electromagnetic casting, but this method requires high investment and extensive control systems. With electromagnetic casting, the pressure differences over the shell are cancelled, i.e. blooms disappear. At the same time, there is no contact between the metal and the mold wall and therefore no inverse segregation zone is formed either. Using conventional casting technology, it is possible to reduce both blooms and inverse segregation by reducing the effect of the chill's contact with the metal.

Using a so-called hot-top with supply devices for gas and oil in the solidification zone for the metal and where a gas cushion is formed under the hot-top, the contact zone with the chill and the heat transfer to the chill are reduced as the distance from the water strike point to the contact zone with the chill wall is reduced. A small inverse segregation zone will be achieved in this way. With this casting method, however, a relatively high metallostatic pressure is used so that there are still some blooms. In addition, the method produces pulsation on account of the gas supply, combined with periodic reduction from the chill wall, which produces an annular segregation process and also an annular topography on the rod.

Using a nozzle/pin or nozzle/float ball, the pressure difference over the solidified shell and the contact zone between the chill and the bar can also be reduced so that the surface segregation decreases. However, this is a method that is difficult to use optimally on account of individual regulation of molds and the safety aspect in that the metal flow may stop suddenly (clogged nozzles). With optimal casting conditions for surface segregation, water will then penetrate into the liquid aluminium and produce a risk of explosion. Therefore, most nozzle/pin processes are operated with a higher metal level in the mold than is optimal for reduced surface segregation, i.e. the motive force for segregation increases.

SUMMARY OF THE INVENTION

The present invention represents a method for continuous or semi-continuous casting of metal in which the above disadvantages of inverse segregation and blooms are considerably reduced or eliminated. Moreover, a solution has been arrived at that produces much greater safety during the casting operation, i.e. an improved HSE solution. Furthermore, a solution has been arrived at that makes it possible to regulate the metal level in the chill(s), i.e. the metal level in relation to primary and secondary cooling, making it simple to adapt the casting operation to the alloy to be cast.

The method is characterised by the metal being supplied to the chill in such a manner and with such regulation that the metallostatic pressure in the contact point (solidification zone) against the chill is virtually zero during casting.

Moreover, the equipment is characterized by the metal being designed to be supplied to the chill in such a manner and with such regulation that the metallostatic pressure in the contact point (solidification zone) against the chill is virtually zero during casting.

BRIEF DESCRIPTION OF THE INVENTION

The present invention will be described in further detail in the following by means of examples and with reference to the attached drawings, where:

Figure 5:
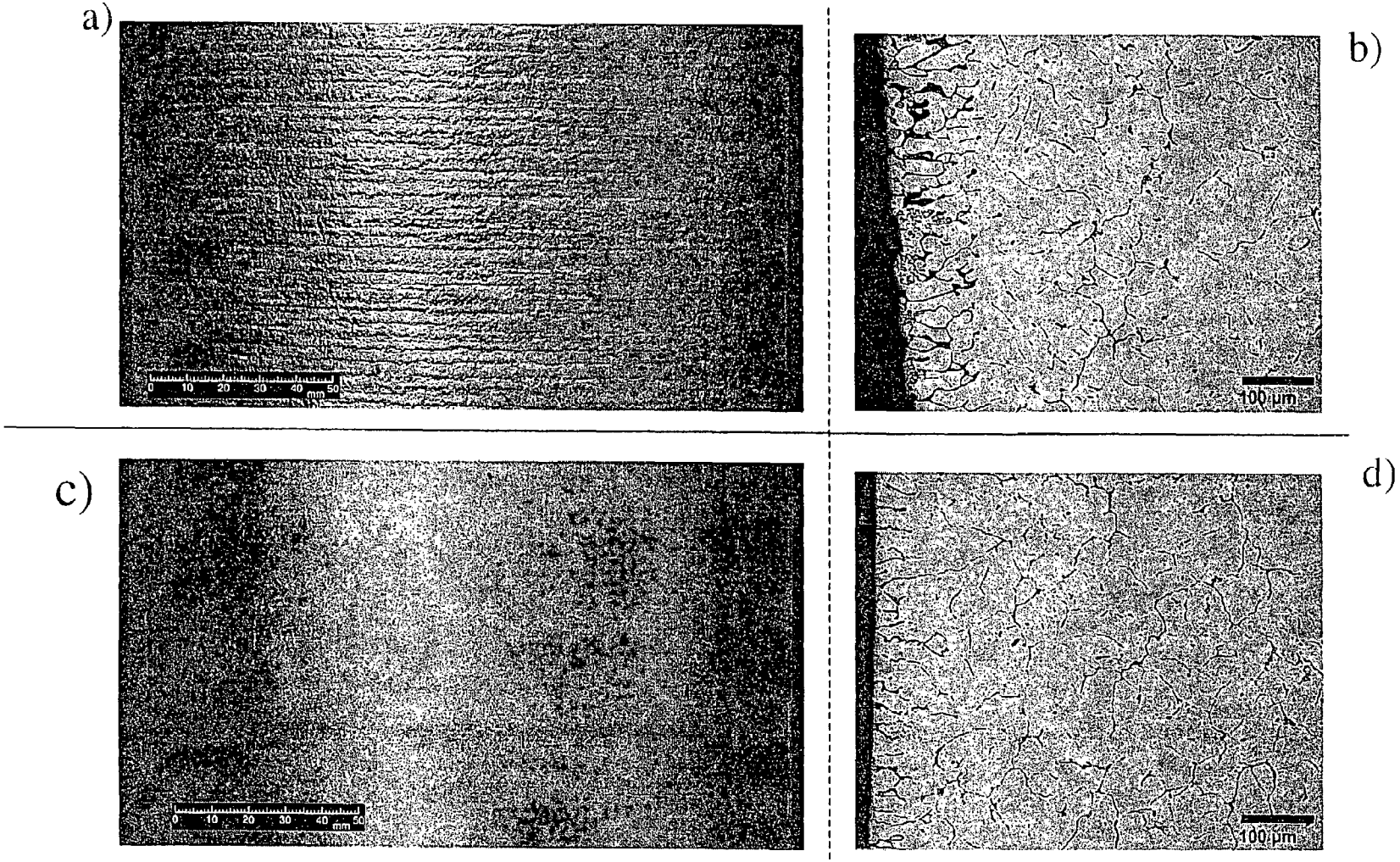

FIG. 5 *a*) and FIG. 5 *c*) show pictures of rods cast with traditional hot-top casting equipment and equipment in accordance with the present invention, respectively, and FIG. 5 *b*) and FIG. 5 *d*) show images of the slip of metal samples of the rods shown in FIGS. 5 *a*) and b) respectively.

DETAILED DESCRIPTION OF THE INVENTION

Figure 1:
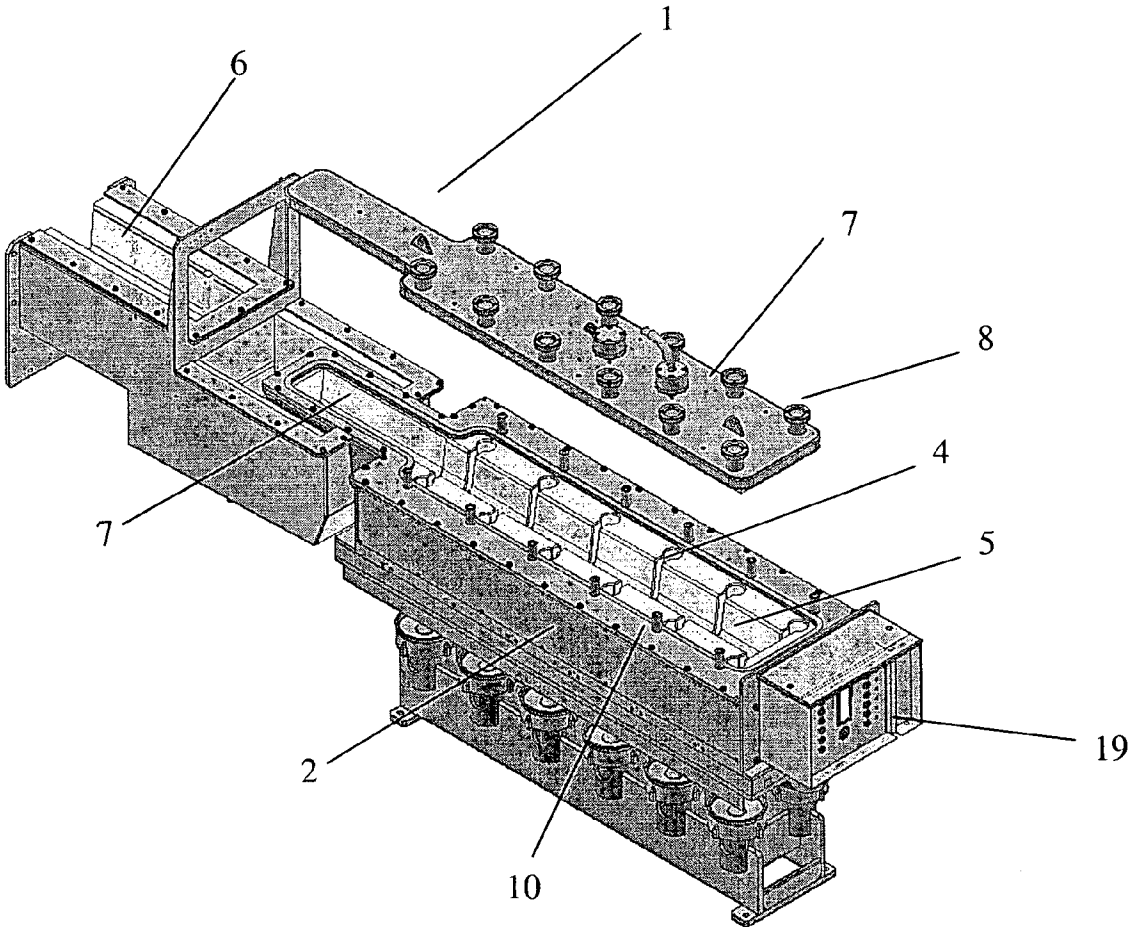
FIG. 1 shows a perspective view, partially seen from the side and from the front, of simple casting equipment in accordance with the present invention, in which a cover that is designed to close the equipment from above is kept open so that it is possible to see partially into the thermally insulated metal supply duct.

As stated above, FIG. 1 shows a perspective view of an example of simple casting equipment 1 in accordance with the present invention for casting extrusion. It is simple in the sense that it only comprises twelve molds 3 (see also FIGS. 2 and 3) with metal inlets 4. This type of equipment may comprise far more chills, up to a few hundred, depending on their diameter, among other things, and may have the capacity to cast tens of tons of metal per hour.

Roughly speaking, in addition to the chills, which are not shown in FIG. 1, the equipment comprises a frame structure 2 with a thermally insulated gully system 6 for the supply of metal from a metal store (holding furnace or similar) and a correspondingly insulated distribution chamber (metal manifold) 5 for distribution of the metal to the respective chills. Over the distribution chamber 5, the equipment is provided with a removable lid or cover 7 that is designed to seal the distribution chamber from the surroundings. Pipe stubs 8 arranged in connection with the cover 7, which are used for inspection during casting, among other things, are connected to the inlet 4 for each chill 3 and are closed during casting, while the ventilation ducts 9 (see also FIGS. 2-3) that emerge in other pipe stubs with a closing device above cover 7 of the equipment are connected to the mold cavity 11 in the mold 3. At the end of the equipment, there is a control panel 19 that does not form part of the present invention and will not be described in further detail here.

Figure 2:
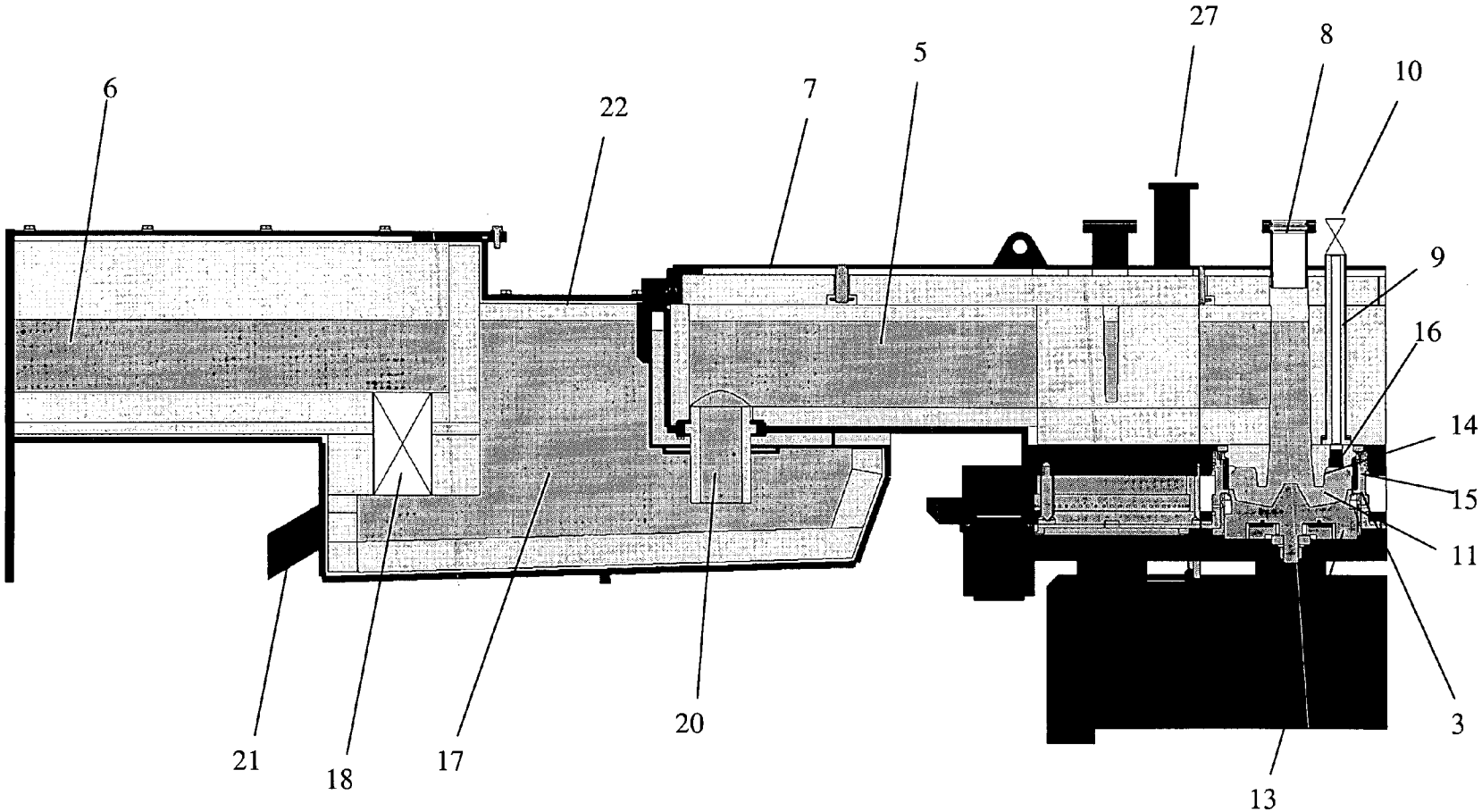
FIG. 2 shows an elevation of the equipment shown in FIG. 1 in which liquid metal is supplied to the equipment during the start of a casting operation.
Figure 3:
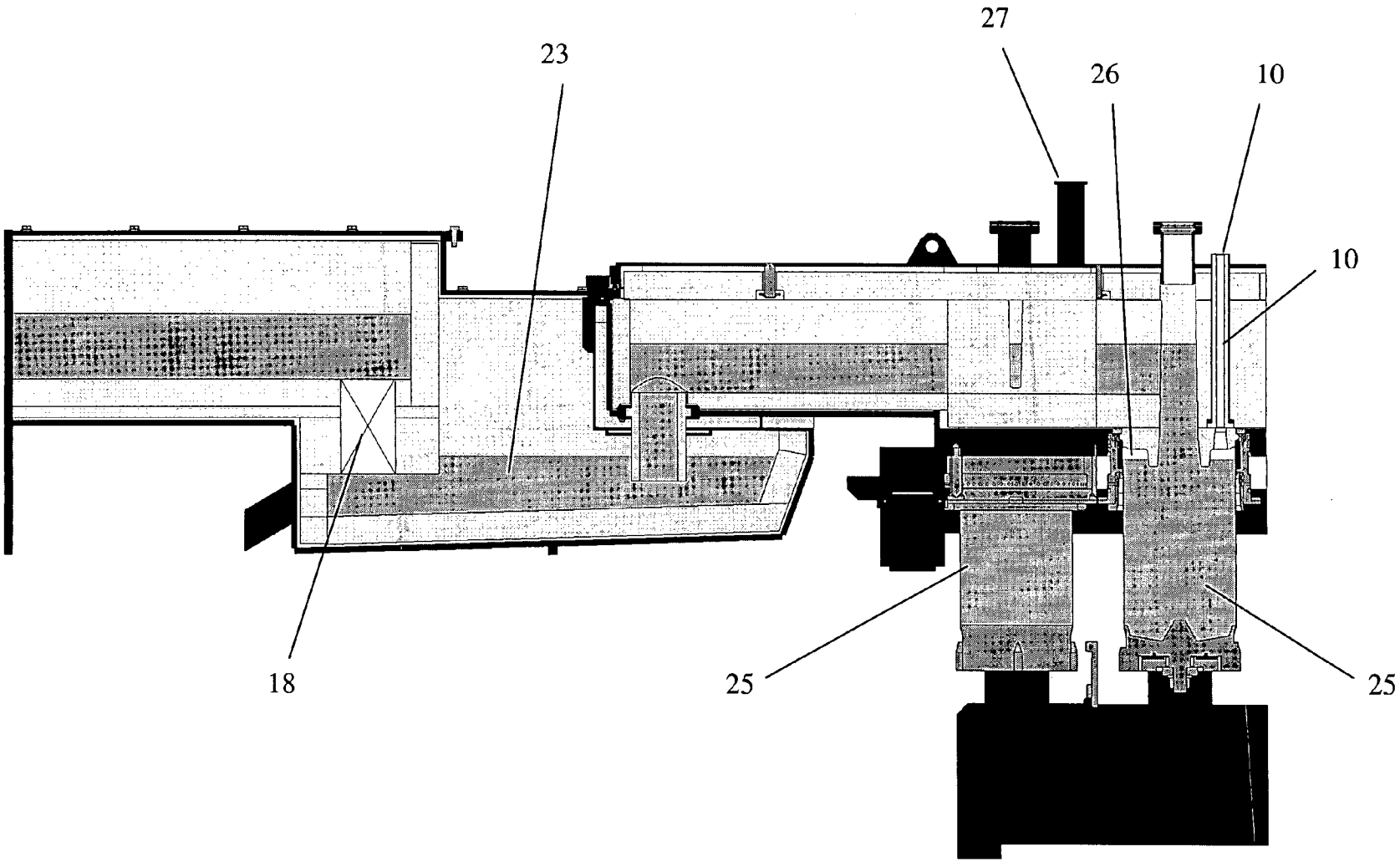
FIG. 3 shows the same as FIG. 2 but during a later stage of the casting operation.

As shown in further detail in FIGS. 2 and 3, the casting equipment shown concerns a vertical, semi-continuous solution in which a moving support 13 is used for each chill 3 to keep the chill closed at the bottom at the beginning of each cast. The chills themselves are of the hot-top type in which a thermally insulating collar or projection 14 is used directly by the inlet to the mold cavity. Moreover, oil and gas are supplied through permeable ring or permeable rings 15 in the wall of the mold cavity 11. As stated above, a ventilation duct 9 is provided for each chill. This is closed by means of a closing device 10 or plug 16 at the beginning of each cast (see the relevant section below).

Furthermore, a connection stub 27 is provided that is designed for connection to a vacuum reservoir (negative pressure reservoir or extraction system) so that a negative pressure can be applied to the distribution chamber 5 during casting (see the relevant section below).

The metal arrives through the gully 6 and is supplied to an intermediate reservoir 17 at a somewhat lower level via a valve device 18 (not shown in detail). The intermediate reservoir 17 is open at the top (at 22) but a duct 20 is designed to pass the metal to the distribution chamber 5, which is located at a higher level, and on to the chills. With this solution, where an intermediate reservoir 17 is provided at a lower level and where the metal is passed (sucked) from this level via the distribution chamber 5 to the mold cavity located at a higher level than the reservoir 17, the siphon principle is used to feed the metal to the chill. Thus it is also possible, by regulating the level in the intermediate reservoir 17, to regulate the level 26 of the metal in the mold cavity 11 and thus also the contact point (solidification zone) against the chill wall. Therefore, by regulating the level in the reservoir 17, the level 26 in the mold cavity is also regulated, while the metallostatic pressure against the contact point 15 in the chill (mold cavity) is virtually zero. This is the core of the present invention and will be explained in further detail in the following.

Regarding the rest of the equipment, a drain stub 21 is provided in connection with the intermediate reservoir 17. Via this drain stub, it is possible to drain (remove) the remaining metal from the distribution chamber 5 and the intermediate reservoir 17.

With reference to FIGS. 2 and 3, the method of operation of the equipment in accordance with the present invention will be described in further detail. FIG. 2 shows the starting point of a casting operation. Metal is supplied from a store (not shown) via the gully 6, through the open valve device 18 to the intermediate reservoir 17, the distribution chamber 5 and the chills 3 (only two chills are shown in these figures for practical reasons). The lid 7 is fitted and the connection stub 27 is connected to the extraction system so that all air is evacuated. The gully 6, the intermediate reservoir 17 and the distribution chamber 5, including the molds 3, are filled to the same level (the metal is shown with a darker grey color). The ventilation pipe 9, which extends from the mold cavity 11, is closed by means of the closing device 10 and/or plug 16.

FIG. 2 shows a situation in which the casting operation has not yet started and the support 13 is kept tight against the outlet of the chill. The valve device 18 is open at this time but will gradually be closed. After the liquid metal has been supplied to the intermediate reservoir 17, the chills and the distribution chamber 5, and has entered equilibrium, the casting operation starts. The metal level in the reservoir 17 will now fall, while the metal level in the distribution chamber 5 will be maintained by means of the negative pressure (in relation to the environment) formed by means of extraction via the connection stub 27. An extrusion ingot 25 is now formed by casting, as shown in FIG. 3. The closing device 10 and/or plug 16 for the ventilation pipe 9 are kept closed and prevent ventilation to the atmosphere until the metallostatic pressure in the chill 11 is equivalent to atmospheric pressure. The plug 16 is then removed and equilibrium exists between the metal level 23 in the reservoir 17 and the metal level 26 in the chill, with the result that metal will flow into the chill 3 when metal is supplied to the intermediate reservoir 17 from the supply gully 6.

FIG. 3 shows the ideal (balanced) casting situation in which the plug 16 has been removed and the valve 10 is open. There is equilibrium between the metal level 26 in the mold 3 and the metal level 23 in the intermediate reservoir 17. In this situation, the metallostatic pressure is virtually zero in the contact point of the metal against the chill. The method in accordance with the present invention is represented, as stated above, precisely by this, namely that the metal is supplied to the chill in such a way and with such regulation that the metallostatic pressure in the contact point against the chill is virtually zero during casting. This is achieved by means of the equipment shown in the figures and described above.

Figure 4:
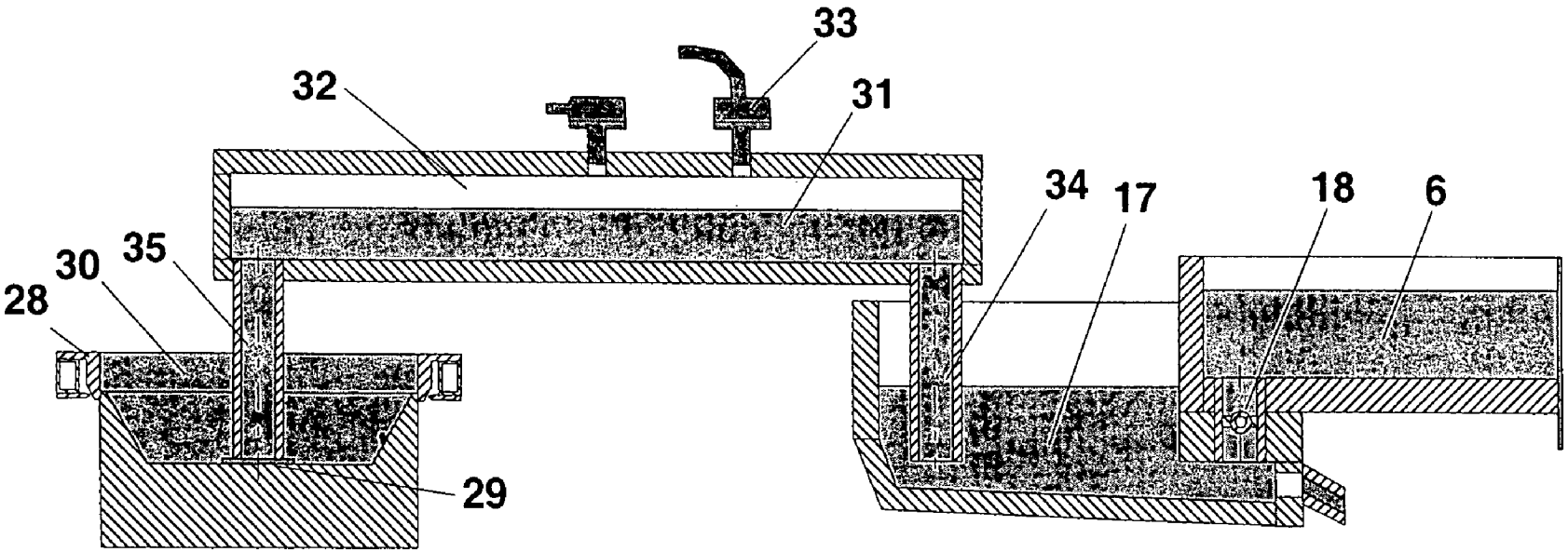
FIG. 4 shows an elevation of alternative casting equipment adapted for casting aluminium wire bars.

An alternative embodiment of the present invention, based on the same principle, is shown in FIG. 4. The present invention is adapted here for casting wire bars. The dimensions of the product (the wire bar) to be cast are much larger compared with casting extrusion ingots described above, where a large number of bars are cast simultaneously. The equipment here comprises the same main components, a supply gully 6 to supply liquid metal from a store, a holding furnace or similar (not shown in further detail), a valve device 18, an intermediate metal reservoir 17 and the casting equipment 30 itself with a wire bar chill 28 for casting wire bars. Instead of a superstructure metal distribution chamber or manifold as shown in FIGS. 1-3 in the previous example, a single transfer duct 31 is used to transfer the metal. This duct comprises a closed gully 32 with a connection stub 33 for connection to a vacuum reservoir or extraction system (not shown in further detail) and an inlet pipe 34 that extends down into the metal melt in the reservoir 17 and an outlet pipe 35 that extends down into the mold cavity in the chill 28. At the beginning of each cast, the outlet pipe, or more precisely its end, is in contact with and sealed by the casting shoe (casting support) 29 in the chill 28. When the gully 32 is then connected to the extraction system via the connection 33, the metal will be sucked up through the inlet pipe 34 and on through the gully 32 to the outlet pipe 35 so that it partly fills the transfer duct 31 as shown in FIG. 4. Thus, the casting operation can begin by the casting shoe 29 being moved downwards and the metal will be transferred from the reservoir 17 to the chill 28 via the transfer duct 31, which thus functions as a siphon. The rest of the casting operation takes place as described in the previous example. In this case too, the counter-pressure is provided by the atmosphere as the chill 28 and the reservoir 17 are open at the top.

However, it should be noted that the present invention, as it is defined in the claims, is not limited to the solutions shown and described above. Therefore, the concept of the present invention will be applicable not only to semi-continuous casting equipment but also to continuous as well as horizontal and vertical continuous casting equipment. Moreover, it is possible to achieve a pressure difference of virtually zero in the contact point against the chill in other ways, for example by pressurizing a casting tank with a pressure equal to the metallostatic pressure in the mold cavity (counter-pressure solution).

The solution is also not limited to so-called hot-top or gas-slip chills but may be used in more traditional directly-cooled casting equipment. Moreover, equipment may also be arranged in connection with the inlet of the chill to agitate the metal in order to reduce further any problems with segregation or blooms. Moreover, in order to eliminate problems with possible oxide formation, an inert gas, for example argon, may be used.

Several tests were carried out in which extrusion ingots of various aluminium alloys were cast using equipment in accordance with the present invention. These were compared with tests in which the same alloys were cast using existing hot-top casting equipment. FIG. 5 *a*) and FIG. 5 *b*) show images of the surface and microslip of a tie rod of alloy AA 6082 cast with existing hot-top equipment, while FIG. 5 *c*) and FIG. 5 *d*) show images of an extrusion ingot cast with equipment in accordance with the present invention. As FIG. 5 *c*) shows, the surface is much finer and smoother for rods cast with the present invention. Moreover, FIG. 5 *d*) clearly shows that the microstructure of an extrusion ingot cast with the present invention has fewer dark pores against the surface that indicate segregation.

The invention claimed is:

1. A method for continuous or semi-continuous casting of metal, the method comprising:

providing at least one direct chill mold having a mold cavity that is provided with an inlet linked to a metal store and an outlet having devices for directly cooling the metal so that an object in the form of a strand, ingot or wire bar can be cast through the outlet;

supplying metal to the mold from the metal store via a metal supply system that is sealed from the environment; and regulating, by means of counter-pressure, the gas pressure over a metal level in the mold in relation to the metallostatic pressure in the mold, such that the metallostatic pressure of the metal in a contact point against the mold at the metal solidification zone in the mold is virtually zero during casting.

2. A method in accordance with claim 1, wherein the metal supply system comprises a duct extending between the mold and an intermediate reservoir, the duct communicates with a vacuum reservoir through a connection stub, and the intermediate metal reservoir is arranged at a lower level than the duct, the method further comprising:

supplying metal to the intermediate metal reservoir via a valve device, wherein the supplying of metal to the intermediate reservoir is regulated by the valve device in order to achieve a siphon effect through the duct, wherein the metal level in the intermediate metal reservoir is the same as or slightly higher than the metal level in the mold cavity in the mold, and the counter pressure in the mold during casting is equivalent to atmospheric pressure.

3. A method in accordance with claim 1, wherein the metal supply system comprises a distribution chamber communicating with the mold and an intermediate reservoir, the distribution chamber is connected to a vacuum reservoir through a connection stub, and the intermediate metal reservoir is arranged at a lower level than the duct, the method further comprising:

supplying metal to the intermediate metal reservoir via a valve device, wherein the supplying of metal to the intermediate reservoir is regulated by the valve device in order to achieve a siphon effect through the distribution chamber, wherein the metal level in the intermediate metal reservoir is the same as or slightly higher than the metal level in the mold cavity in the mold, and the counter pressure in the mold during casting is equivalent to atmospheric pressure.

4. A method in accordance with claim 1, wherein the mold includes a chill that is provided with permeable wall elements for the supply of gas and/or oil to the metal solidification zone.

5. Equipment for continuous or semi-continuous casting of metal, the equipment comprising:

a metal store;

at least one direct chill mold having a mold cavity provided with an inlet linked to the metal store and an outlet provided with devices for cooling the metal so that an object in the form of a strand, ingot or wire bar can be cast through the outlet, a metal supply system disposed between the metal store and the inlet of the mold, wherein the metal supply system is sealed from the environment; and counter-pressure means for regulating the gas pressure over the metal level in the mold in relation to the metallostatic pressure in the mold such that the metallostatic pressure of the metal in a contact point against the mold at the metal solidification zone is virtually zero during casting.

6. The equipment as claimed in claim 5, wherein the metal supply system comprises a distribution chamber having a connection stub in communication with a vacuum reservoir, the counter-pressure means comprising:

an intermediate metal reservoir arranged at a lower level than the distribution chamber; and a valve device positioned in an inlet of the intermediate metal reservoir, wherein the supply of metal to the intermediate metal reservoir can be regulated so as to achieve a siphon effect via the distribution chamber, wherein the metal level in the intermediate metal reservoir is virtually the same as or slightly higher than the metal level in the mold cavity in the mold, and the counter-pressure in the mold during casting is equivalent to atmospheric pressure.

7. The equipment as claimed in claim 5, wherein the metal supply system comprises a duct having a connection stub in communication with a vacuum reservoir, the counter-pressure means comprising:

an intermediate metal reservoir arranged at a lower level than the duct; and a valve device positioned in an inlet of the intermediate metal reservoir, wherein the supply of metal to the intermediate metal reservoir can be regulated so as to achieve a siphon effect via the duct, wherein the metal level in the reservoir is virtually the same as or slightly higher than the metal level in the mold cavity in the mold, and the counter-pressure in mold during casting is equivalent to atmospheric pressure.

8. The equipment as claimed in claim 5, wherein the mold includes a chill that is of the hot-top type and comprises permeable rings or wall elements for the supply of gas and/or oil to a metal solidification zone.

9. The equipment as claimed in claim 6, wherein the intermediate metal reservoir has an open top, and the distribution chamber is sealed by a lid.

10. The equipment as claimed in claim 7, wherein the intermediate metal reservoir has an open top, and communicates with the duct via a vertical inlet pipe.

* * * * *